US009719635B2

(12) United States Patent
Chen

(10) Patent No.: US 9,719,635 B2
(45) Date of Patent: Aug. 1, 2017

(54) BULB-TYPE LAMP STRUCTURE

(71) Applicant: Deng Yun Lighting Co., Ltd., Taichung (TW)

(72) Inventor: Chi-Che Chen, Taichung (TW)

(73) Assignee: DENG YUN LIGHTING CO., LTD., Taichung (TW)

( * ) Notice: Subject to any disclaimer, the term of this patent is extended or adjusted under 35 U.S.C. 154(b) by 40 days.

(21) Appl. No.: 14/885,991

(22) Filed: Oct. 16, 2015

(65) Prior Publication Data

US 2016/0238198 A1 Aug. 18, 2016

(30) Foreign Application Priority Data

Feb. 17, 2015 (TW) ..... 104105486 A

(51) Int. Cl.

| | |
|---|---|
| ***F21K 99/00*** | (2016.01) |
| ***F21V 29/70*** | (2015.01) |
| ***F21V 23/00*** | (2015.01) |
| ***F21V 3/02*** | (2006.01) |
| ***F21V 3/04*** | (2006.01) |
| ***F21V 17/10*** | (2006.01) |
| ***F21V 29/74*** | (2015.01) |
| ***F21K 9/232*** | (2016.01) |
| ***F21K 9/238*** | (2016.01) |
| *F21Y 101/02* | (2006.01) |
| *F21Y 105/00* | (2016.01) |
| *F21V 17/00* | (2006.01) |
| *F21Y 105/10* | (2016.01) |
| *F21Y 115/10* | (2016.01) |

(52) U.S. Cl.

CPC ..... *F21K 9/1355* (2013.01); *F21K 9/232* (2016.08); *F21K 9/238* (2016.08); *F21V 3/02* (2013.01); *F21V 3/0409* (2013.01); *F21V 17/10* (2013.01); *F21V 23/003* (2013.01); *F21V 29/70* (2015.01); *F21V 29/74* (2015.01); *F21V 17/002* (2013.01); *F21Y 2101/02* (2013.01); *F21Y 2105/001* (2013.01); *F21Y 2105/10* (2016.08); *F21Y 2115/10* (2016.08)

(58) Field of Classification Search

CPC ..... F21K 9/1355; F21K 9/232; F21V 29/70; F21V 29/74; F21V 3/02; F21V 3/0409; F21V 17/10; F21V 23/003; F21V 17/002; F21V 2105/10; F21V 2115/10; F21V 2101/02; F21V 2105/001; F21V 2101/00

USPC ..... 362/294

See application file for complete search history.

(56) References Cited

U.S. PATENT DOCUMENTS

2012/0014117 A1* 1/2012 Huang ..... F21V 3/00 362/373

2012/0026740 A1* 2/2012 Kim ..... F21V 3/00 362/294

(Continued)

*Primary Examiner* — Laura Tso

(57) ABSTRACT

A bulb-type lamp structure contains: a heat dissipation body, an electronic board, a base, and a peripheral sleeve. The heat dissipation body includes a driver fixed therein, and the electronic board includes plural illumining elements arranged thereon. A first end of the heat dissipation body is connected with the base, and a second end of the heat dissipation body is coupled with the peripheral sleeve. The electronic board is electronically connected with the driver, and the driver is electronically coupled with the base, wherein the peripheral sleeve is a colorful cover.

9 Claims, 8 Drawing Sheets

(56) References Cited

U.S. PATENT DOCUMENTS

| | | | | |
|---|---|---|---|---|
| 2012/0195043 | A1* | 8/2012 | Watanabe | F21V 29/004 362/249.02 |
| 2012/0236569 | A1* | 9/2012 | Chang | F21V 3/02 362/294 |
| 2013/0215625 | A1* | 8/2013 | Takeuchi | F21V 23/001 362/363 |
| 2014/0043815 | A1* | 2/2014 | Chuang | F21V 29/2262 362/249.02 |
| 2014/0078723 | A1* | 3/2014 | Chen | F21V 23/023 362/184 |
| 2014/0153251 | A1* | 6/2014 | Yang | F21V 7/0008 362/294 |

* cited by examiner

BULB-TYPE LAMP STRUCTURE

FIELD OF THE INVENTION

The present invention relates to a blub-type lamp structure which produces gradient visual colors.

BACKGROUND OF THE INVENTION

A conventional LED lamp contains a heat dissipation body in which a driver is fixed, an electronic board on which a plurality of LED elements are arranged, a base, and a peripheral sleeve. A first end of the heat dissipation body is connected with the base, and a second end of the heat dissipation body is coupled with the peripheral sleeve. The electronic board is electronically connected with the driver, and the driver is electronically coupled with the base.

The peripheral sleeve is a transparent cover made of plastic material, such that when each LED element emits white lights or yellow lights, the white or yellow lights project through the peripheral sleeve. Therefore, the conventional LED lamp cannot produce gradient visual colors.

To overcome such a problem, a conventional lampshade is disclosed in TW Publication No. M462831 and is connected with a lamp holder and a light emitting unit, wherein the lampshade includes a first cover, a second cover, and a connecting loop.

The first cover is in connection with the lamp holder, the connecting loop is coupled with the first cover and the second cover, such that the lampshade is assembled to project lights of different colors or transmittances through the first cover, the second cover, and the connecting loop.

However, the conventional lampshade is complicated and is manufactured at high cost. After the connecting loop is adhered with the first cover and the second cover, the first cover is adhered with the lamp holder, thus assembling the lampshade troublesomely.

The present invention has arisen to mitigate and/or obviate the afore-described disadvantages.

SUMMARY OF THE INVENTION

One aspect of the present invention is to provide a blub-type lamp structure which produces gradient visual colors.

Further aspect of the present invention is to provide a blub-type lamp structure which produces visual effect of different colors by using a peripheral sleeve easily.

Another aspect of the present invention is to provide a blub-type lamp structure which is simplified, compact, assembled easily, and produced at low cost.

To obtain the above aspects, a blub-type lamp structure provided by the present invention contains: a heat dissipation body, an electronic board, a base, and a peripheral sleeve.

The heat dissipation body includes a driver fixed therein, and the electronic board includes plural illumining elements arranged thereon. A first end of the heat dissipation body is connected with the base, and a second end of the heat dissipation body is coupled with the peripheral sleeve. The electronic board is electronically connected with the driver, and the driver is electronically coupled with the base, wherein the peripheral sleeve is a colorful cover.

Preferably, the bulb-type lamp structure further comprises a lid mounted on a bottom of the peripheral sleeve.

Preferably, the peripheral sleeve is made of plastic material.

Preferably, the peripheral sleeve is made of glass material.

Preferably, the peripheral sleeve is in an arc shape.

Preferably, the bulb-type lamp structure further comprises a lampshade assembly configured to accommodate a bulb-type lamp structure.

Preferably, the bulb-type lamp structure further comprises a fixer locked on the second end of the heat dissipation body so as to connect with the electronic board.

Preferably, the peripheral sleeve is adhered with the hollow fixer.

Preferably, the peripheral sleeve includes plural locking pegs arranged on one end thereof facing to the fixer, and the fixer includes plural orifices defined on one end thereof so as to correspond to the plural pegs, wherein the plural pegs of the peripheral sleeve insert into the plural orifice of the fixer.

Preferably, the peripheral sleeve includes plural retaining tabs arranged on the one end thereof facing to the fixer, and the fixer includes plural recesses defined on the one end thereof so as to correspond to the plural retaining tabs, wherein the plural retaining tabs of the peripheral sleeve insert into the plural recesses of the fixer.

DETAILED DESCRIPTION OF THE PREFERRED EMBODIMENTS

Figure 1:
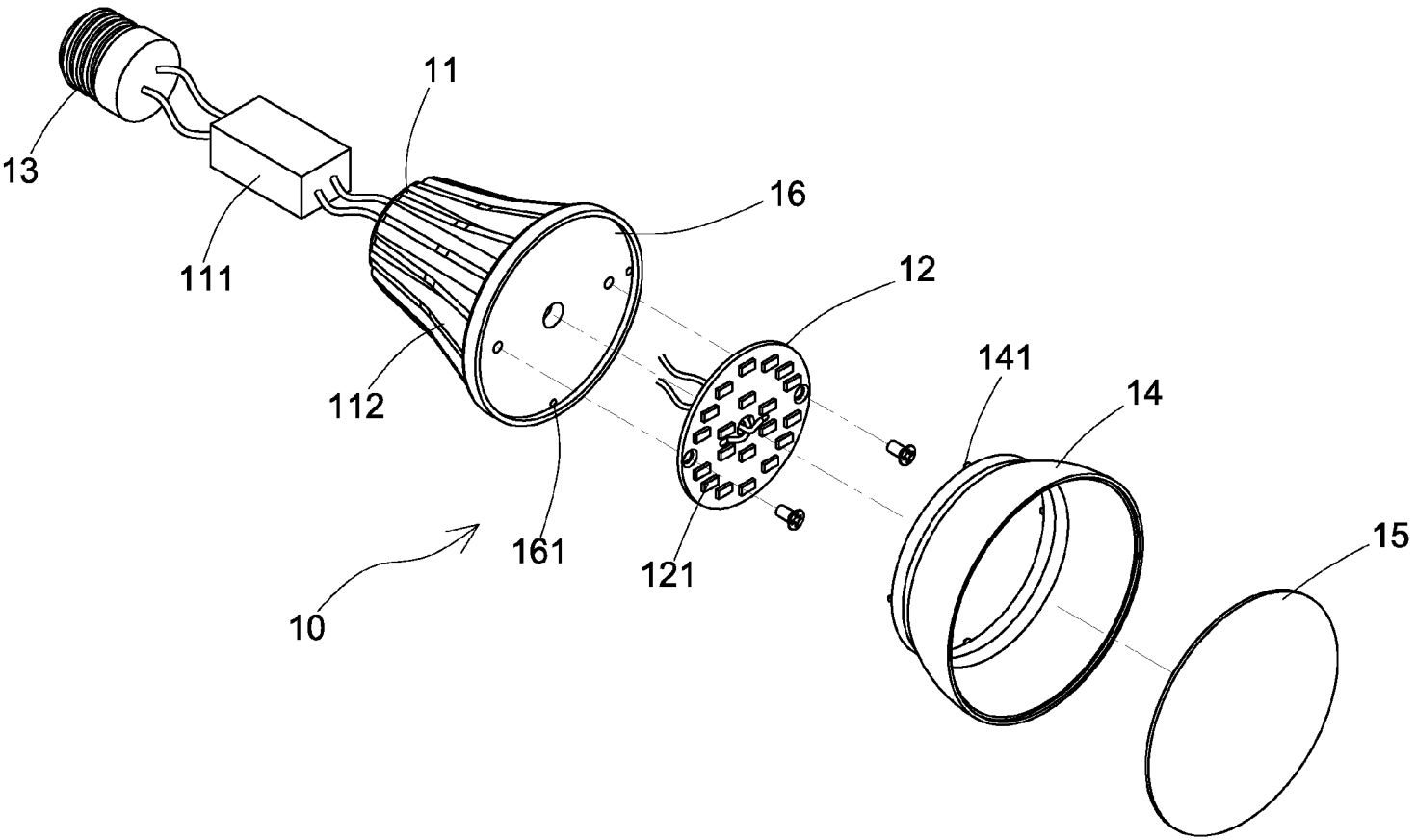
FIG. 1 is a perspective view showing the exploded components of a bulb-type lamp structure according to a preferred embodiment of the present invention.
Figure 2:
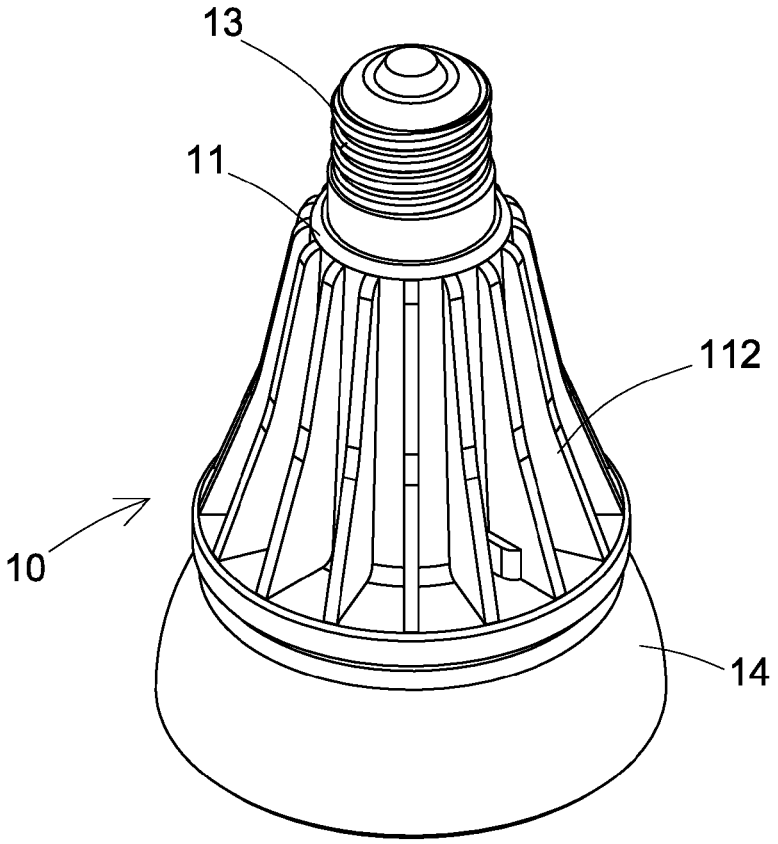
FIG. 2 is a perspective view showing the assembly of the bulb-type lamp structure according to the preferred embodiment of the present invention.
Figure 3:
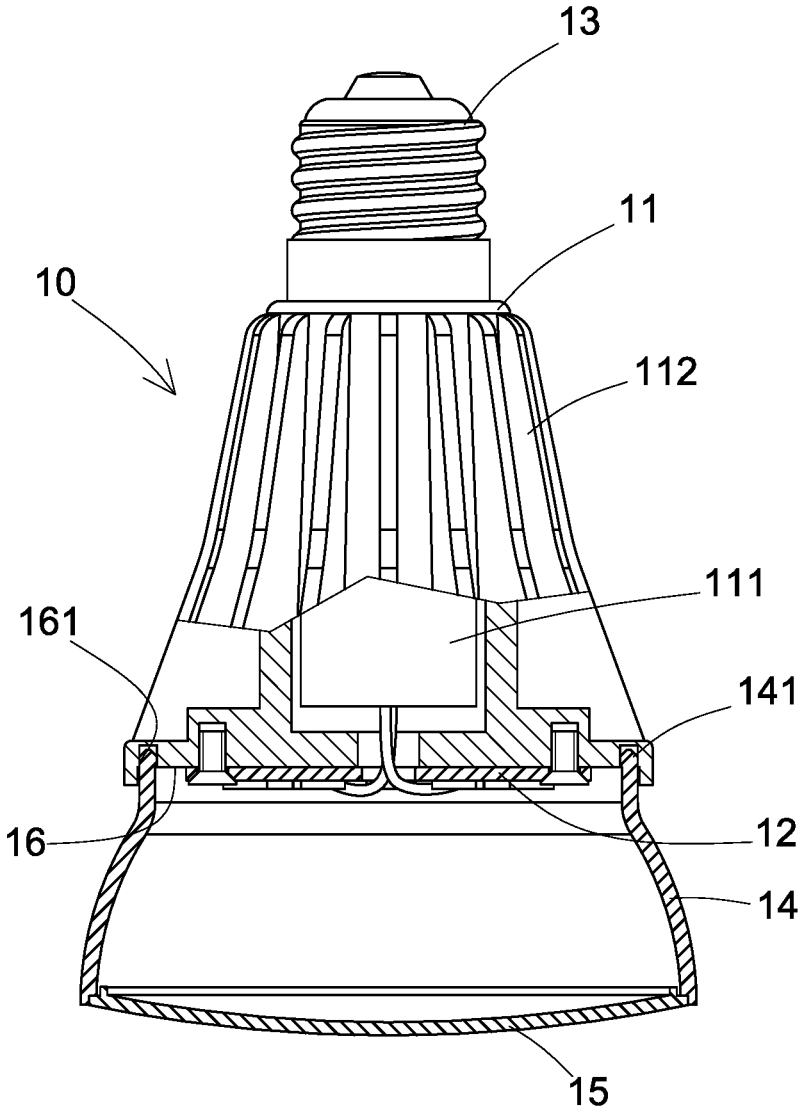
FIG. 3 is a cross sectional view showing the assembly of a part of the bulb-type lamp structure according to the preferred embodiment of the present invention.

With reference to FIGS. 1 to 8, a bulb-type lamp structure 10 according to a preferred embodiment of the present invention comprises: a heat dissipation body 11 in which a driver 111 is fixed, an electronic board 12 on which plural illumining elements 121 are arranged, a base 13, and a peripheral sleeve 14. A first end of the heat dissipation body 11 is connected with the base 13, and a second end of the heat dissipation body 11 is coupled with the peripheral sleeve 14. The electronic board 12 is electronically connected with the driver 111, the driver 111 is electronically coupled with the base 13, and the base 13 is accommodated in a lamp holder (not shown), such that the plural illumining elements 121 emit lights for illumination.

It is to be noted that the peripheral sleeve 14 is a colorful cover and its outer periphery connects with an external rim of the heat dissipation body 11 so as to form an outer wall of the bulb-type lamp structure 10.

The peripheral sleeve 14 is made of plastic material.

Alternatively, the peripheral sleeve 14 is made of glass material.

Figure 6:
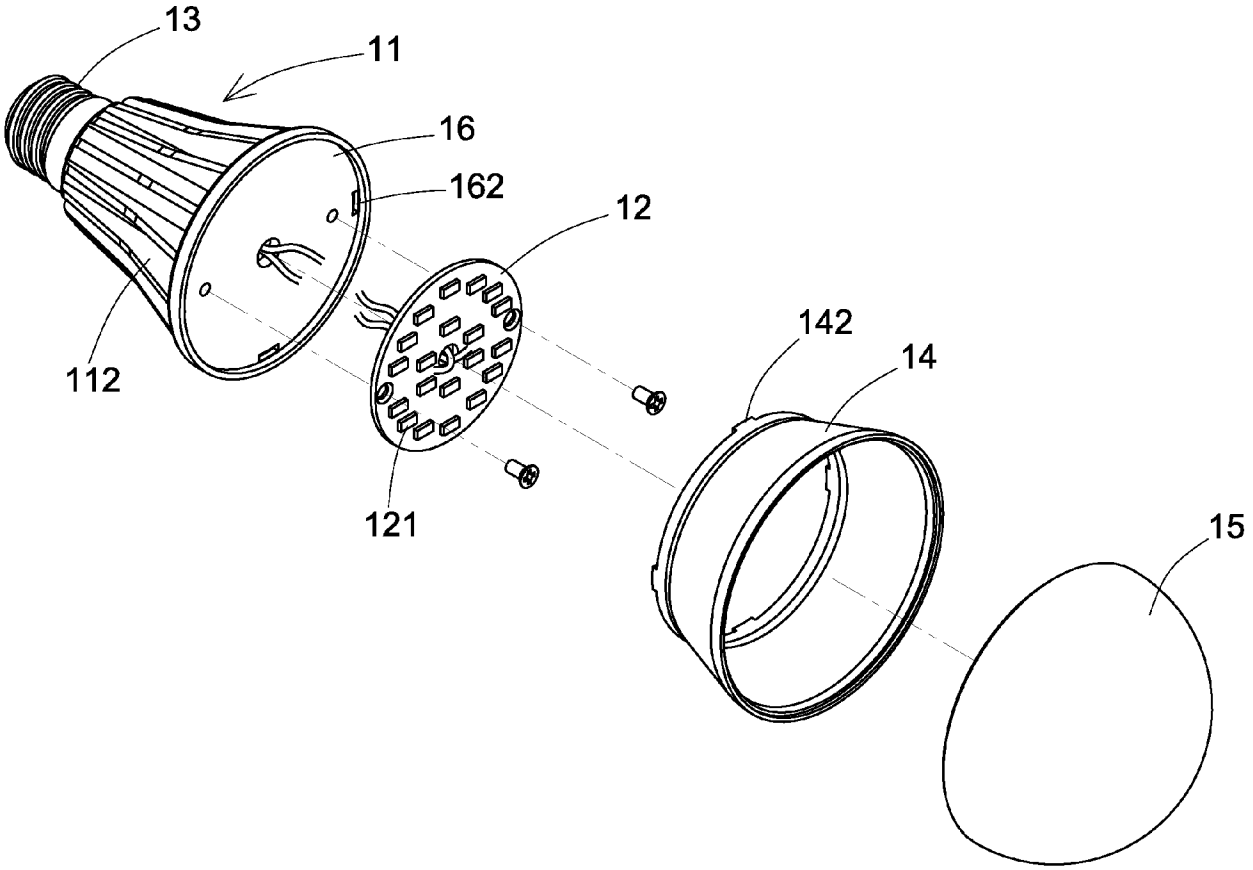
FIG. 6 is a perspective view showing the exploded components of a bulb-type lamp structure according to another preferred embodiment of the present invention.
Figure 7:
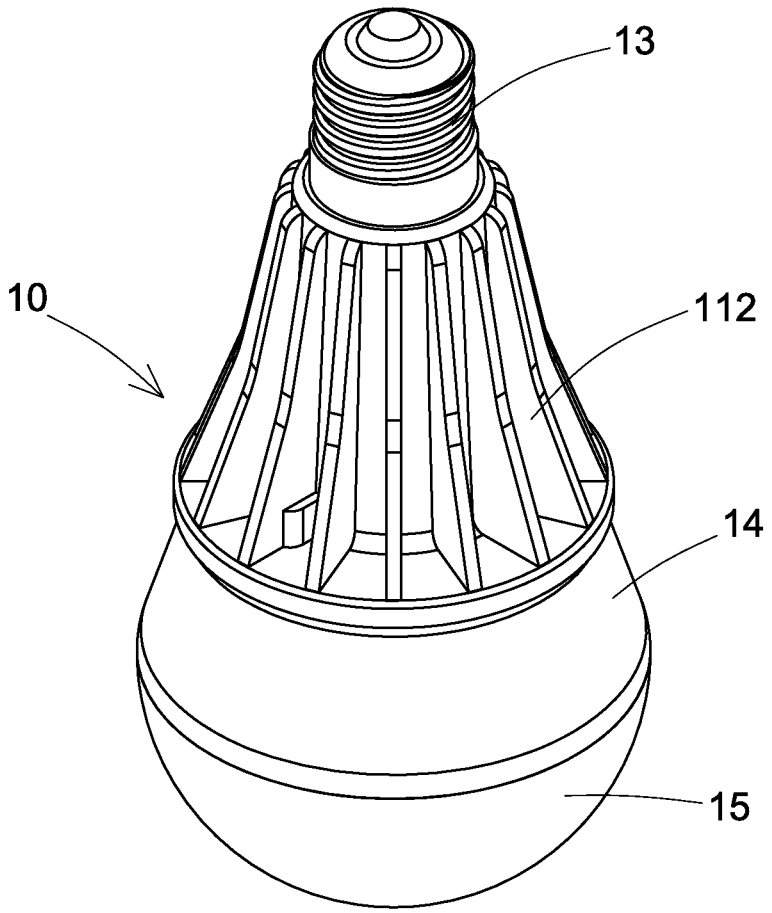
FIG. 7 is a perspective view showing the assembly of the bulb-type lamp structure according to said another preferred embodiment of the present invention.
Figure 8:
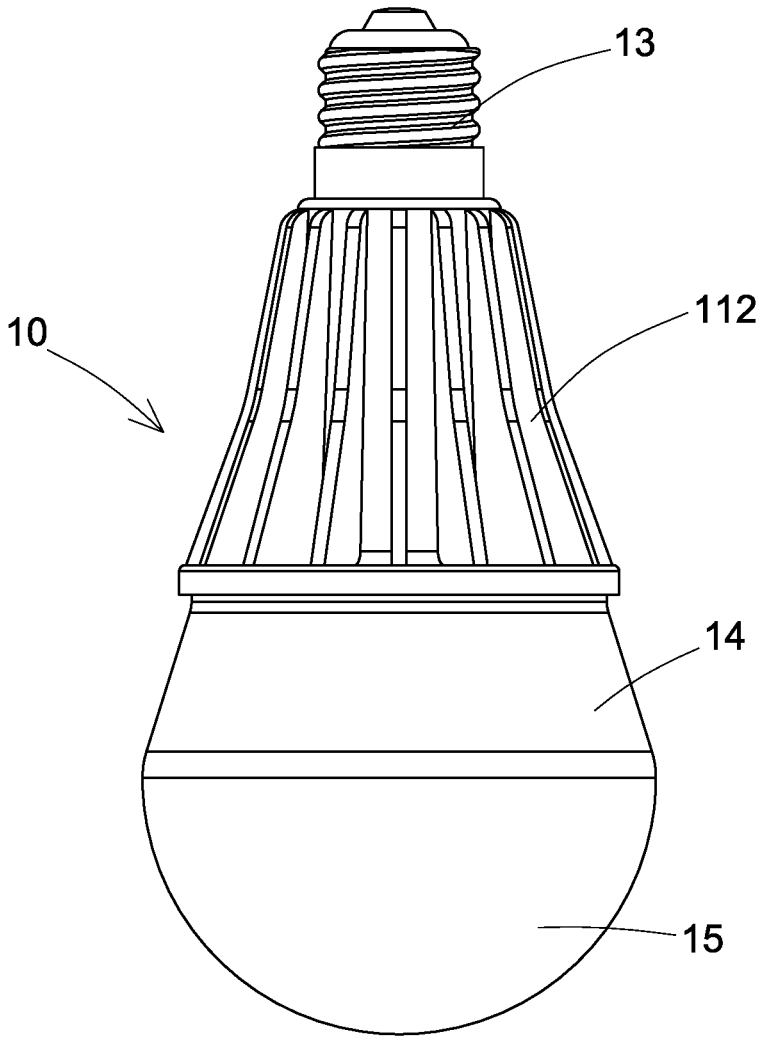
FIG. 8 is a cross sectional view showing the assembly of the bulb-type lamp structure according to said another preferred embodiment of the present invention.

The bulb-type lamp structure 10 further comprises a transparent or nontransparent lid 15 made of plastic material, and the lid 15 is mounted on a bottom of the peripheral sleeve 14 to cover the electronic board 12, wherein the lid 15 is flat (as shown in FIG. 1) or is curved (as illustrated in FIG. 6).

The heat dissipation body 11 includes a plurality of heat radiating fins 112 arranged around the outer wall thereof, and the plurality of heat radiating fins 112 are made of metal or plastic material.

The peripheral sleeve 14 is in any one of a column shape, a cylinder shape, an arc shape, a semi-circle shape, and a cone shape.

Each illumining element 121 is a white light-emitting diode or a yellow light-emitting diode.

The bulb-type lamp structure 10 further comprises a fixer 16 locked on the second end of the heat dissipation body 11 so as to connect with the electronic board 12.

The peripheral sleeve 14 is adhered with the hollow fixer 16.

The peripheral sleeve 14 includes plural locking pegs 141 arranged on one end thereof facing to the fixer 16, and the fixer 16 includes plural orifices 161 defined on one end thereof so as to correspond to the plural pegs 141, such that the plural pegs 141 of the peripheral sleeve 14 insert into the plural orifice 161 of the fixer 16.

Alternatively, the peripheral sleeve 14 includes plural retaining tabs 142 arranged on the one end thereof facing to the fixer 16, and the fixer 16 includes plural recesses 162 defined on the one end thereof so as to correspond to the plural retaining tabs 142, such that the plural retaining tabs 142 of the peripheral sleeve 14 insert into the plural recesses 162 of the fixer 16, as illustrated in FIG. 6.

Figure 5:
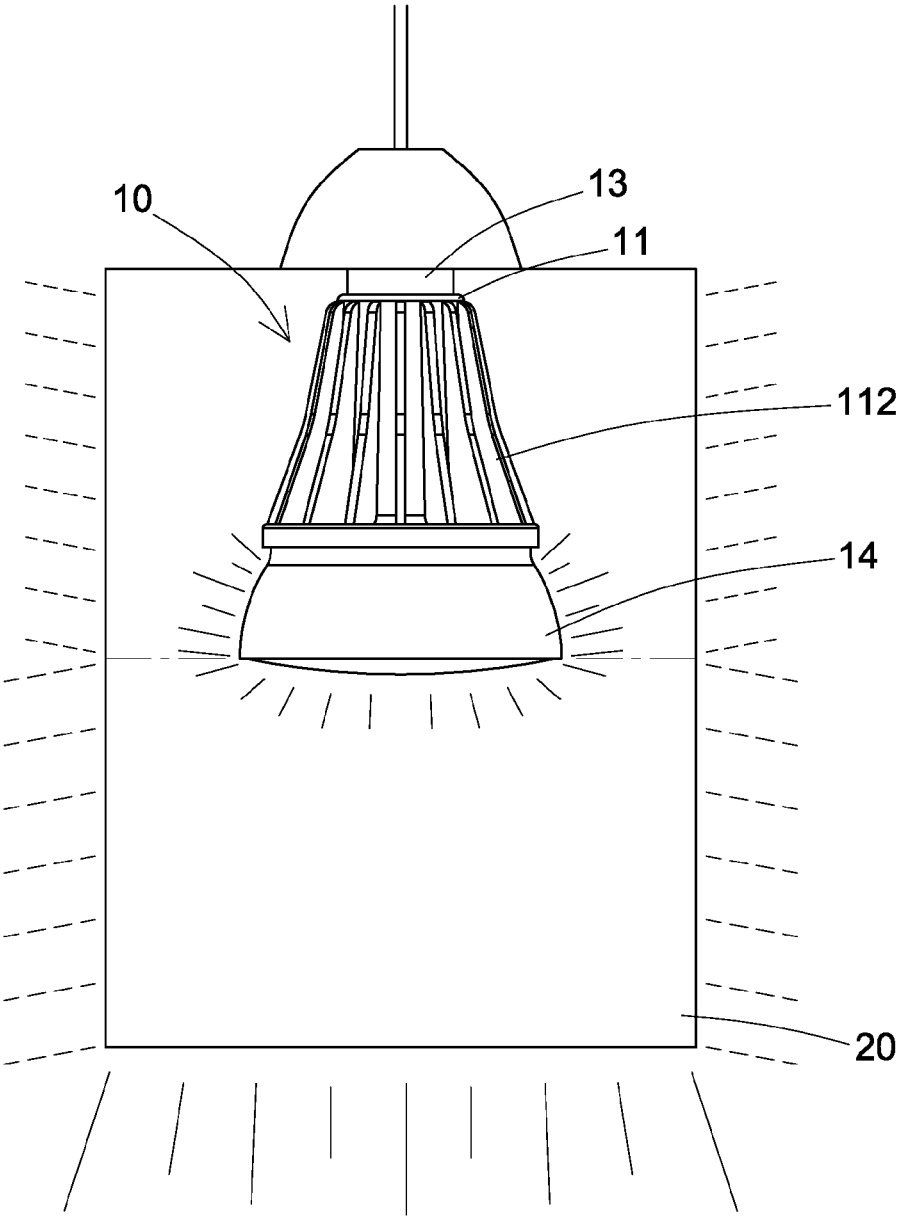
FIG. 5 is another side plane view showing the application of the bulb-type lamp structure according to the preferred embodiment of the present invention.

In addition, a lampshade assembly 20 is configured to accommodate the bulb-type lamp structure 10, as shown in FIG. 5.

Referring to FIGS. 1 to 8, the fixer 13 is fixed on the lamp holder (not shown) which electrically connects with a power source, such that the plural illumining elements 121 emit the lights.

Figure 4:
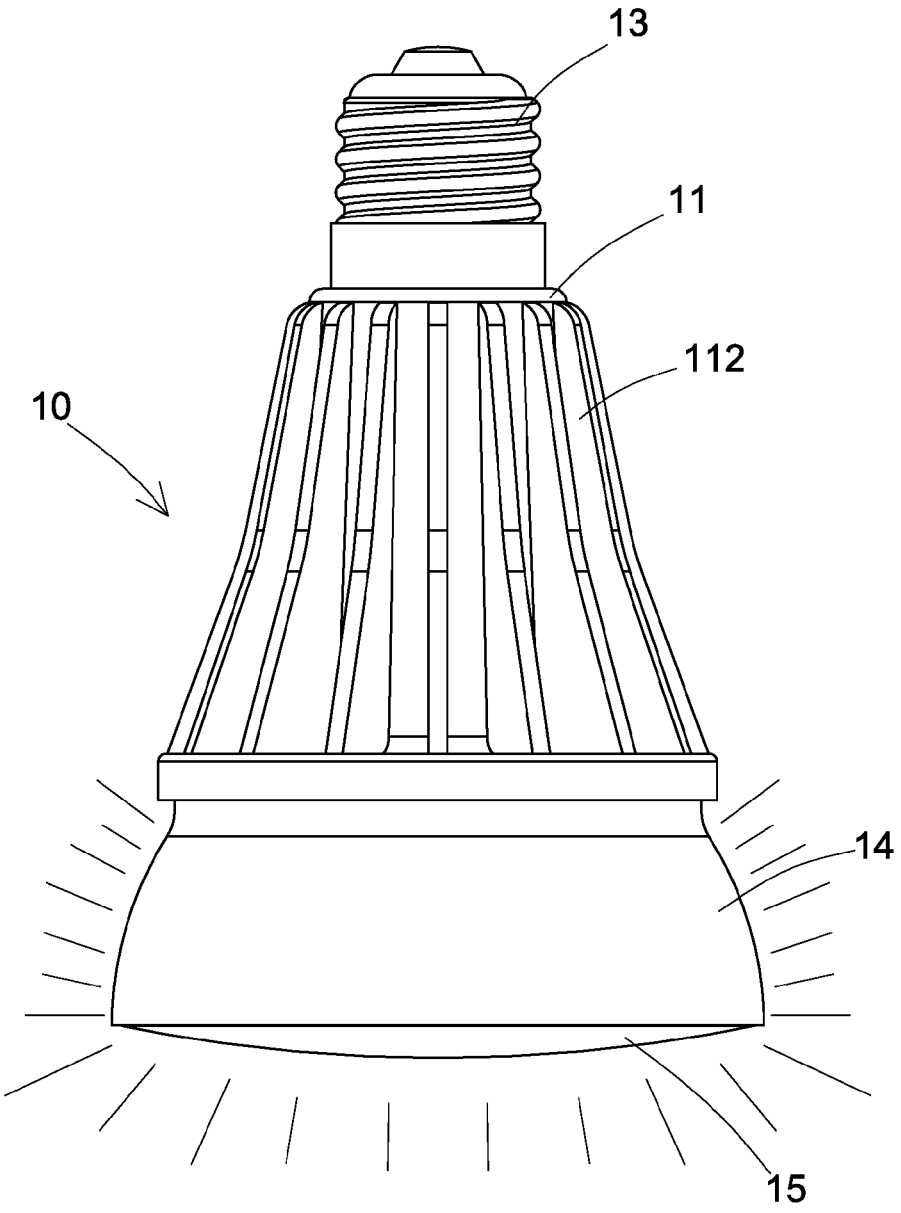
FIG. 4 is a side plane view showing the application of the bulb-type lamp structure according to the preferred embodiment of the present invention.

Preferably, the peripheral sleeve 14 is the color cover and is made of plastic material or glass material, the bulb-type lamp structure 10 emits lights of different colors, wherein when said each illumining element 121 of the electronic board 12 is the white light-emitting diode, it emits white light, and colorful lights illuminate via the peripheral sleeve 14. When said each illumining element 121 of the electronic board 12 is the yellow light-emitting diode, it emits yellow light, and the colorful lights illuminate via the peripheral sleeve 14, thus producing visual effect of different colors by using the peripheral sleeve 14, as shown in FIG. 4.

The bulb-type lamp structure 10 is accommodated in the lampshade assembly 20, as illustrated in FIG. 5, and the peripheral sleeve 14 of the bulb-type lamp structure 10 is the colorful cover, so gradient visual colors produce. For example, when said each illumining element 121 is the white light-emitting diode and the peripheral sleeve 14 is purple, one part of the lampshade assembly 20 above the peripheral sleeve 14 illuminates purple lights, and the other part of the lampshade assembly 20 below the peripheral sleeve 14 illuminates white lights, as illustrated in FIG. 5, thus forming the visual effect of different colors.

Accordingly, the peripheral sleeve 14 and the bulb-type lamp structure 10 are combined together to produce lights of different colors by replacing various bulbs quickly.

Preferably, the bulb-type lamp structure of the present invention is simplified, compact, assembled easily, and produced at low cost.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A bulb-type lamp structure comprising: a heat dissipation body in which a driver is fixed, an electronic board on which plural illumining elements are arranged, a base, and a peripheral sleeve; a first end of the heat dissipation body being connected with the base, and a second end of the heat dissipation body being coupled with the peripheral sleeve, the electronic board being electronically connected with the driver, and the driver being electronically coupled with the base;

wherein the peripheral sleeve is a cover with a specific color different from an original color of the plural illumining elements, the bulb-type lamp structure further comprises a transparent lid mounted on a bottom of the peripheral sleeve, such that when the plural illumining elements of the electronic board emit lights, the transparent lid projects the original color of the plural illumining elements and the peripheral sleeve projects the specific color of the peripheral sleeve or a mixing color of the original color of the plural illumining elements and the specific color of the peripheral sleeve, thus producing visual effect of different colors by using the peripheral sleeve and the transparent lid.

2. The bulb-type lamp structure as claimed in claim 1, wherein the peripheral sleeve is made of plastic material.

3. The bulb-type lamp structure as claimed in claim 1, wherein the peripheral sleeve is made of glass material.

4. The bulb-type lamp structure as claimed in claim 1, wherein the peripheral sleeve is in an arc shape.

5. The bulb-type lamp structure as claimed in claim 1 further comprising a lampshade assembly configured to accommodate a bulb-type lamp structure.

6. The bulb-type lamp structure as claimed in claim 1 further comprising a fixer locked on the second end of the heat dissipation body so as to connect with the electronic board.

7. The bulb-type lamp structure as claimed in claim 6, wherein the peripheral sleeve is adhered with the hollow fixer.

8. The bulb-type lamp structure as claimed in claim 6, wherein the peripheral sleeve includes plural locking pegs arranged on one end thereof facing to the fixer, and the fixer includes plural orifices defined on one end thereof so as to correspond to the plural pegs, wherein the plural pegs of the peripheral sleeve insert into the plural orifice of the fixer.

9. The bulb-type lamp structure as claimed in claim 6, wherein the peripheral sleeve includes plural retaining tabs arranged on the one end thereof facing to the fixer, and the fixer includes plural recesses defined on the one end thereof so as to correspond to the plural retaining tabs, wherein the plural retaining tabs of the peripheral sleeve insert into the plural recesses of the fixer.

* * * * *